United States Patent [19]

Newman

[11] 4,444,100

[45] Apr. 24, 1984

[54] CAN CRUSHING MACHINE

[75] Inventor: James T. Newman, Jamestown, N. Dak.

[73] Assignee: Canmaster, Inc., Jamestown, N. Dak.

[21] Appl. No.: 336,576

[22] Filed: Jan. 4, 1982

[51] Int. Cl.[3] ..... B30B 9/32

[52] U.S. Cl. ..... 100/157; 100/49; 100/902; 241/228

[58] Field of Search ..... 100/49, 157, 902; 241/99, 228; 99/574

[56] References Cited

U.S. PATENT DOCUMENTS

| | | | |
|---|---|---|---|
| 49,088 | 8/1865 | Crever | 100/157 |
| 373,342 | 11/1887 | Cornelius | 241/222 |
| 410,879 | 9/1889 | Cornelius | 241/228 |
| 1,655,333 | 1/1928 | Perazio | 100/157 |
| 2,356,122 | 8/1944 | Edwards | 100/902 X |
| 2,619,150 | 11/1952 | Smith | 100/902 X |
| 2,877,723 | 3/1959 | Decker | 100/902 X |
| 3,036,517 | 5/1962 | Malarsky | 100/902 X |
| 3,776,128 | 12/1973 | Morris | 100/902 X |
| 3,827,351 | 8/1974 | Rosenow | 100/902 X |
| 4,235,164 | 11/1980 | Allen et al. | 100/902 X |

FOREIGN PATENT DOCUMENTS

| | | | |
|---|---|---|---|
| 1196535 | 11/1959 | France | 100/157 |
| 209857 | 1/1924 | United Kingdom | 241/228 |
| 301242 | 11/1928 | United Kingdom | 241/228 |

*Primary Examiner*—Billy J. Wilhite

*Attorney, Agent, or Firm*—Kinney, Lange, Braddock, Westman and Fairbairn

[57] ABSTRACT

An apparatus for crushing cans inserted into an opening in the housing thereof. The cans are crushed between a rotary drum and a roller rotatably mounted within the drum. A slide guide means directs the cans into the nip between the roller and drum. Crushed cans drop through an opening into a collecting bin.

6 Claims, 6 Drawing Figures

CAN CRUSHING MACHINE

DESCRIPTION

BACKGROUND OF THE INVENTION

1. Field of the Invention

This invention relates to machinery and, more particularly, to a machine for crushing empty cans.

2. Description of the Prior Art

A number of machines for crushing metal cans to facilitate their recycling and eventual re-use have been shown in the prior art. U.S. Pat. No. 2,356,122 shows a crushing machine utilizing crusher disks to perform the crushing action. The crusher disks utilize conical working faces oriented in a converging relation to grip and crush cans delivered into a proper position by a chute.

U.S. Pat. No. 2,877,723 pertains to a garbage and refuse incinerator utilizing interfitting conically shaped crushing members having corrugated surface characteristics to crush incombustible waste material deposited into the residue receiver from a combustion area.

U.S. Pat. No. 3,036,517 relates to a can crusher utilizing a stationary crushing plate and a movable crushing plate driven by an eccentric cam to perform the crushing action.

U.S. Pat. No. 3,776,128 utilizes a conveyor to move cans from a hopper to a jaw mechanism which partially collapses the cans and then to a pair of counter-rotating rollers which further compresses them. Synchronization of the jaw crushing element to the conveyor is required for proper operation.

U.S. Pat. No. 3,827,351 utilizes a pair of rollers having a substantially square cross-section with rounded edges to form the crusher elements. The square cross-section rollers require special gearing and power trains to rotate them in a 45° out-of-phase relationship to flatten or crush cans and bottles in the interfitting flat surfaces of the rollers. One of the rollers is mounted on a spring-biased yoke member to allow it to be moved away from the other member in the event that a non-crushable object is inserted into the apparatus.

SUMMARY OF THE INVENTION

In the prior art machines, relatively complex synchronized drive arrangements are necessary to provide proper operation of the crusher. Such drive arrangements would tend to result in a more complex and often a larger machine. The complexity of the drive also has adverse effects upon the cost of the unit.

In accordance with one aspect of this invention, there is provided a machine for crushing cans comprising a housing with a can receiving opening, a base plate mounted in the housing with a can disposal opening in it, drum means rotatably mounted on the base plate above the can disposal opening, drive means for rotating the drum means, roller means mounted in engagement with the inner wall portion of the drum means for rotation therewith for crushing cans inserted in the nip between said roller means and said drum means and releasing crushed cans to fall through the can disposal opening, and a guide means positioned in the housing for receiving cans inserted in the housing through the can receiving opening and inserting said cans in the nip between said roller means and said drum means. There is additionally provided storage means for collecting crushed cans falling through the can disposal opening and control means responsive to the insertion of cans through said can receiving opening for operating the drive means for a predetermined period of time after insertion of the last can of a series of cans through said can receiving opening.

BRIEF DESCRIPTION OF THE DRAWINGS

There is hereafter described a preferred embodiment of the subject invention with reference being made to the following Figures in which.

DETAILED DESCRIPTION OF THE DRAWINGS

Figure 1:
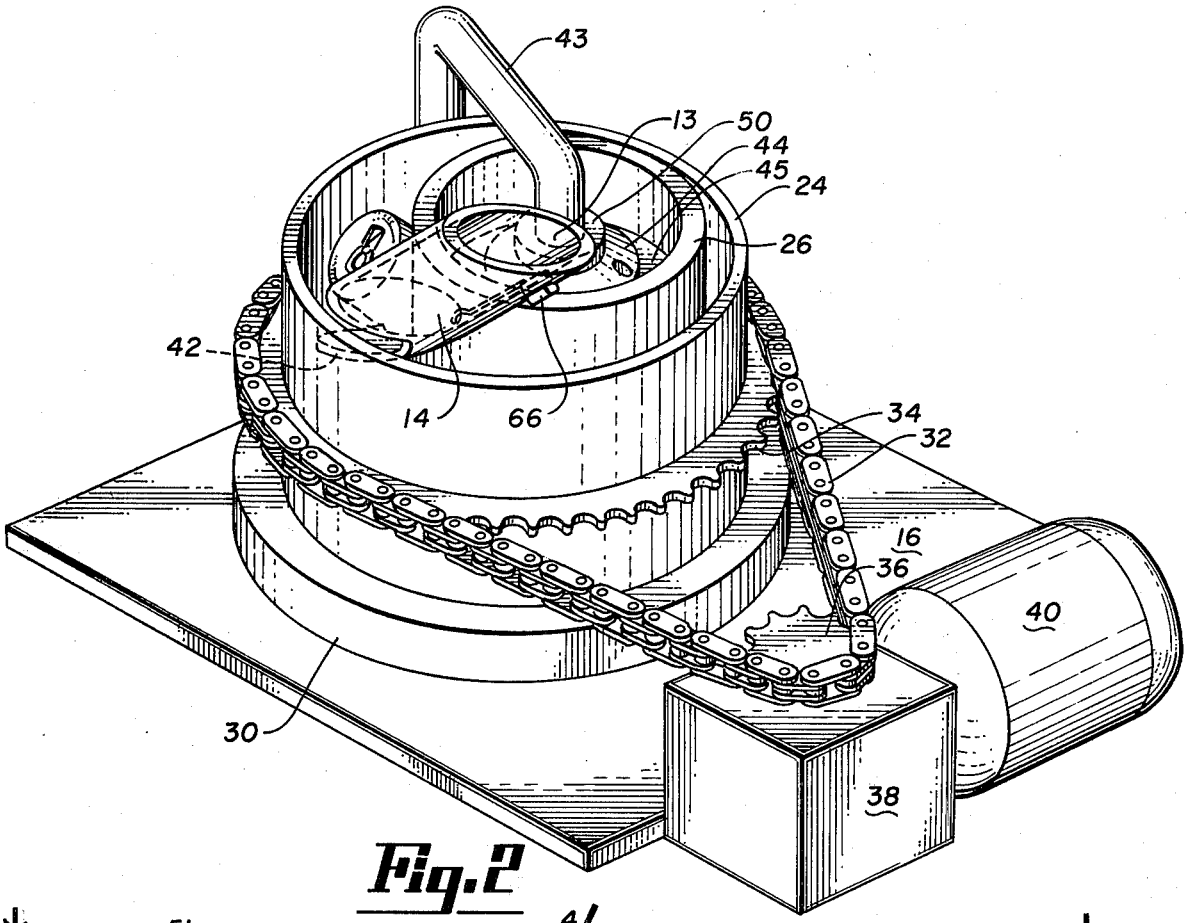
FIG. 1 is a perspective view of the mechanism for crushing cans with the housing removed for clarity to permit viewing of the interrelated parts.
Figure 5:
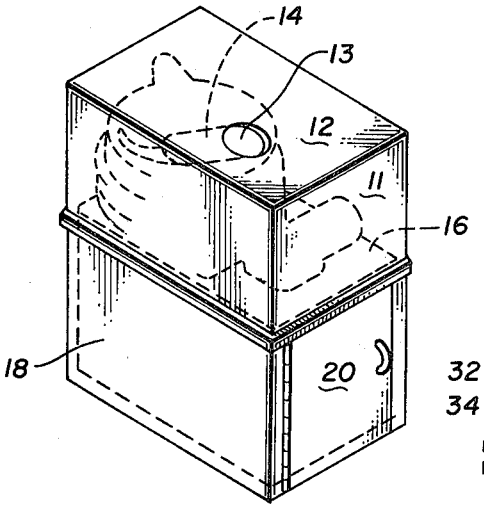
FIG. 5 is a simplified perspective view of the crusher machine with the interior mechanism shown in phantom outline.

Turning now to FIG. 1, the can crushing machine is shown in perspective view with the enclosure omitted. The structure shown in FIG. 1 can be enclosed in one of a number of housings. FIG. 5 shows, in simplified form, a typical housing 11 with a hinged cover 12 which includes an opening 13 to the can input chute or guide 14. The crushing mechanism is mounted on a bed or base plate 16 which is positioned above a crushed can receiving container 18. An access door 20 permits the crushed can container 18 to be removed and emptied periodically. The entire housing 11 can be conveniently mounted in the service area in a bar or restaurant because it is self-contained, extremely compact and operates with a minimum of noise.

The chute 14, which is supported at the top of the housing 11, serves as a guide to direct empty cans inserted into the machine into the operating mechanism with a proper orientation for efficient operation. The crushing operation is performed by an outer drum 24 and an inner roller 26 which is mounted for rotation within outer drum 24 against the inner surface thereof.

Figure 4:
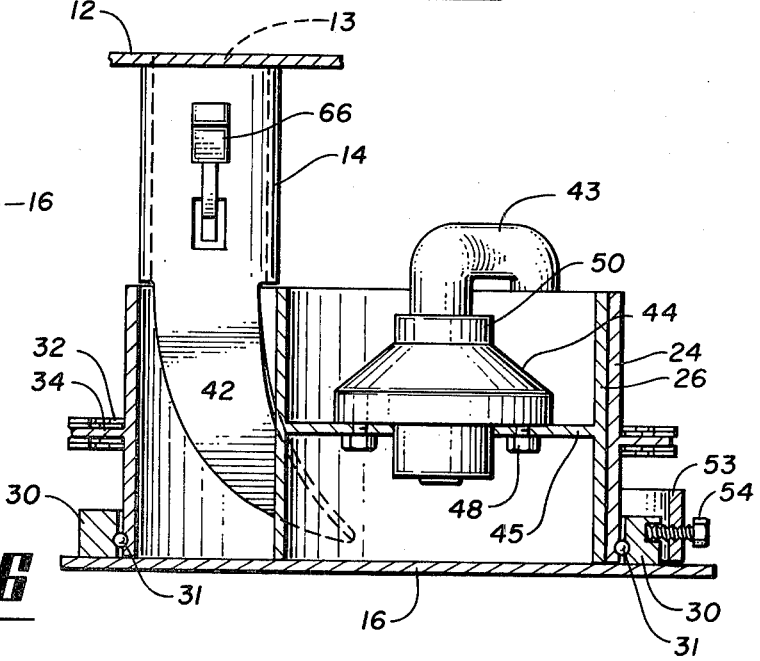
FIG. 4 is a section view taken along the lines 4—4 of FIG. 2.

As shown in FIG. 4, the outside wall of drum 24 has an annular bearing race therein which is engaged by ball bearings 31 supported in a bearing race in nylon bearing block 30. The bearings 31 retain the axis of drum 24 in the proper position on the surface of plate 16 while allowing rotation of the drum about its vertical axis.

Assembly of the bearing assembly is accomplished during construction of the machine by inserting ball bearings 31 into the race formed by the annular grooves. The bearings 31 may be inserted individually through an access hole bored through bearing block 30, and drum 24 is rotated slightly after each ball 31 is inserted. The hole is then sealed. Maintenance of a minimum clearance between adjacent bearings may be assured by inserting short spacer rods between bearing balls 31 as the bearing assembly is completed.

The mounting arrangement permits drum 24 to be rotated readily about its axis while providing stability to restrain the drum from translational movement along the surface of the plate 16.

The drum 24 is rotated about its axis by a chain 32 which engages an annular sprocket 34 mounted on the outer surface of drum 24. Chain 32 is driven by a sprocket 36 which is, in turn, driven by a right angle gear box 38 powered by a motor 40.

Cans deposited in the chute 14 slide under the influence of gravity onto a slide 42, which is positioned between roller 26 and the inner wall of drum 24. The roller 26 is concentrically mounted on an arm 43 with its outer surface in contact with the inner wall of drum 24.

Figure 3:
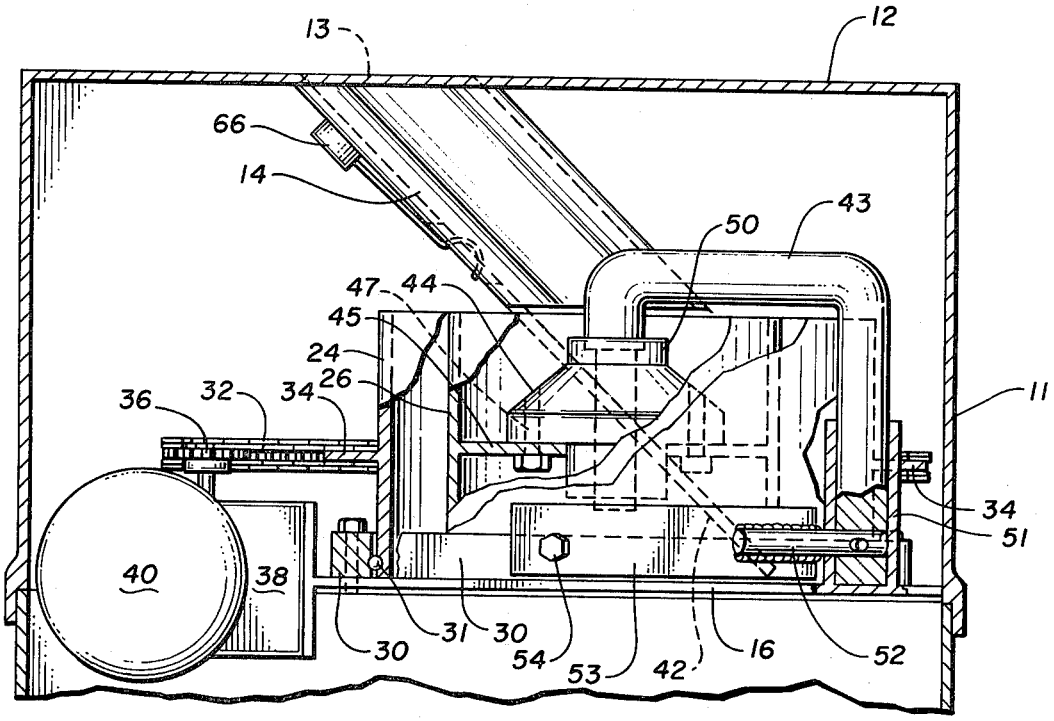
FIG. 3 is a section view taken along the lines 3—3 of FIG. 2.

The details of the mounting of roller 26 inside drum 24 are shown most clearly in the cross-sectional views in FIGS. 3 and 4. As can be seen in those Figures, the roller 26 includes an inner annular flanged portion 45 which is attached to a hub 44 mounted on arm 43 shaft or spindle 46. In one embodiment, the flange 45 may be formed by welding a quarter-inch disk to the inside of the roller 26. In the preferred embodiment shown, the inner roller 26 can be formed from a section of eight-inch pipe, while the outer drum can be formed from a section of standard twelve-inch pipe. The connection between the inner flange 45 and the hub 44 is by means of hub mounted studs or bolts 47 and lug nuts 48. Hub 44 may be a conventionally available automotive type hub which can be secured using six lug nuts 47. Hub 44 is rotatable about the vertical axis of arm 43 on a tapered roller bearing assembly 50. The body of the roller 26 is freely rotatable about the axis of arm 43 while being extremely strong and resistant to tilting or bending during crushing operations.

Figure 2:
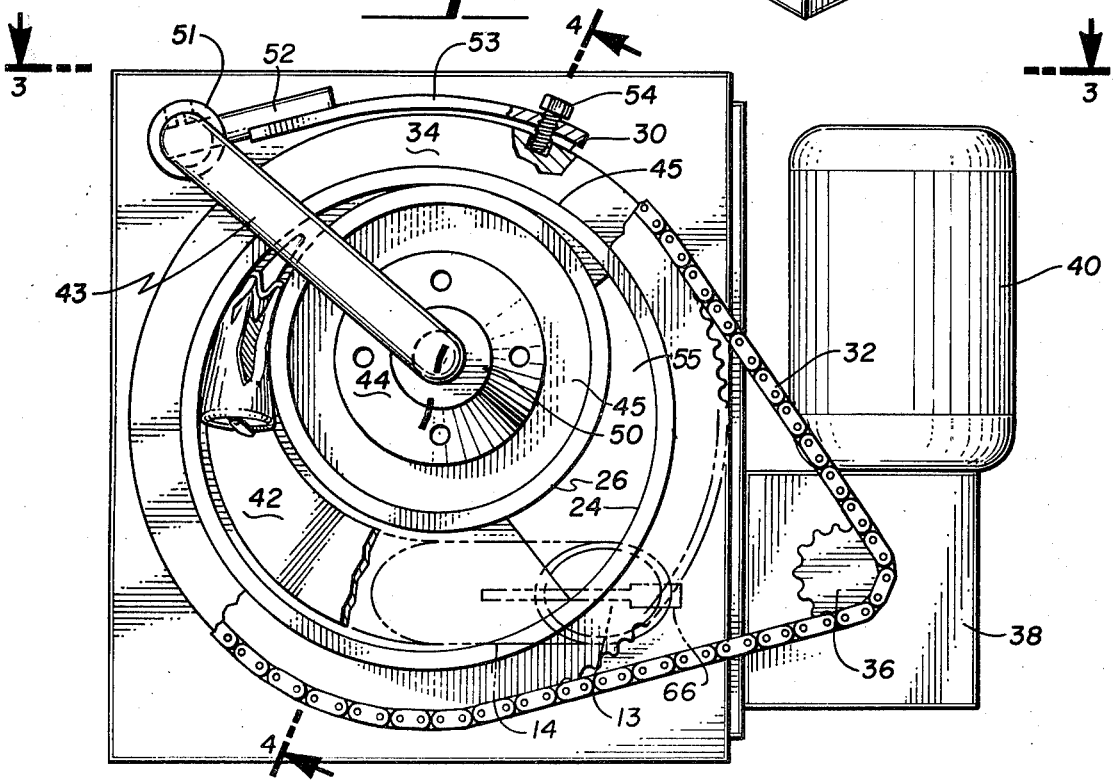
FIG. 2 is a top schematic view of the crusher mechanism.

The operation of the crusher can be seen, for example, in the top view of FIG. 2. The can is inserted into the crushing mechanism through guide 14 and is transported along chute 14 and slide 42 into the nip formed between the outer surface of the roller 26 and the inner wall of the drum 24. The can, after travelling through the nip formed between roller 26 and drum 24, drops through an opening 55 through plate 16 into the crushed can container 18 below the plate 16.

In order to avoid damage to the crusher in the event that a solid unyielding object is inserted in the crusher, the inner roller 26 is pivotally movable away from the inner wall of drum 24 when the force exerted between the drum 24 and roller 26 exceeds a predetermined amount. The roller 26 and its hub 44 are mounted on the bearing assembly 50 to firmly support the roller 26 while permitting it to freely rotate against the inner wall of drum 24.

The base of arm 43 is supported in a vertical sleeve 51 which is mounted on the base plate 16. Sleeve 51 permits rotation of arm 43 to allow the inner roller 26 to be pivotted away from the inner surface of drum 24. An extension member 52, connected to arm 43, projects through a hole in sleeve 51 and is attached to one end of a leaf spring 53. The other end of the leaf spring 53 has an adjustment bolt 54 therein which bears against the inner wall of a recess in the bearing block 30. Mounted as described and shown, the leaf spring 53 urges the extension member 52 in direction such that the inner roller 26 mounted on arm 43 is urged toward the inner wall of the outer drum 24. As shown best in FIGS. 2 and 4, the extension of bolt 54 from the leaf spring 53 as it bears on the block 30 alters the force which urges roller 26 against the inner wall of drum 24.

Figure 6:
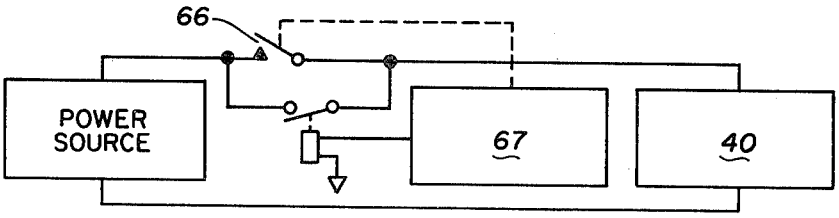
FIG. 6 is a block diagram of the electrical control circuit used in the crusher machine.

In order to provide for convenient operation of the crusher, a microswitch 66 is positioned in the an input chute 14 with its switch arm 68 positioned to be tripped by cans deposited in the chute. Using conventional electric circuitry shown in simplified form in FIG. 6, the actuation of the switch 66 applies power to operate the motor 40 to drive the crushing mechanism. A parallel solenoid operated switch 67 controlled by a timer opens a predetermined time after switch 66 opens after the last of a series of cans is inserted for a predetermined period of time after the switch has been closed. In other words, the crusher continues to operate for a fixed time period determined by the timer.

I claim:

1. A machine for crushing cans comprising:

a base portion;

drum means having a drum wall with an inner surface generated about a central axis and a generally concentric outer surface, said drum means having a length in direction along the central axis, the drum wall terminating along a plane generally perpendicular to the central axis to define an interior chamber having a wall;

means to rotatably mount the drum means on the base portion for rotation about the central axis including bearing means positioned to the exterior of the drum wall and engaging the drum wall;

roller means positioned on the interior of the drum means and having an outer surface;

support means mounted on the base portion and including a section extending along the exterior of the drum means and spanning the drum wall;

means on the support means for rotatably mounting the roller means on the interior of the chamber with the outer surface of the roller means in engagement with the inner surface of the drum means for rotation about an axis parallel to the central axis;

means for spring loading the roller means against the inner surface of the drum wall with a force sufficient to crush a can introduced into a nip defined by the convergence of the outer surface of the roller means and the inner surface of the drum wall; and drive means for rotating the drum means comprising an endless flexible drive member surrounding the outer surface of the drum wall at location along the length of the drum wall, and motor means mounted on the base driving the endless flexible drive member to thereby rotate the drum means and to move cans to be crushed engaged by the drum wall and roller means into said nip and past said roller means for crushing said can.

2. The invention of claim 1, and further comprising:

means for introducing cans to be crushed into the nip between the outer surface of the roller means and the inner surface of the drum wall.

3. The invention of claim 1, and further comprising:

means for collecting those cans which have been crushed.

4. The invention of claim 1 wherein the resilient urging means forces the outer surface of the roller means against the inner surface of the drum wall with a predetermined amount of force and permits the roller means to move away from the inner surface of the drum wall when a force exerted against the drum wall and roller means by an object passing therebetween exceeds that predetermined amount.

5. The invention of claim 4, and further comprising:

force adjustment means for selectively controlling the predetermined amount of force exerted by the resilient urging means.

6. The invention of claim 1 wherein the inner surface of the drum walls and the outer surface of the roller means are generally circular in cross-section, with the circular outer surface having a smaller diameter than the circular inner surface.

* * * * *